United States Patent [19]

McLaughlin et al.

[11] Patent Number: 4,898,316

[45] Date of Patent: Feb. 6, 1990

[54] FASTENER MAGAZINE AND GUIDE DEVICE

[75] Inventors: John E. McLaughlin; Thomas A. McCardle, both of Cincinnati, Ohio

[73] Assignee: Senco Products, Inc., Cincinnati, Ohio

[21] Appl. No.: 323,859

[22] Filed: Mar. 15, 1989

[51] Int. Cl.[4] ..... B25C 7/00

[52] U.S. Cl. ..... 227/120

[58] Field of Search ..... 227/120, 7

[56] References Cited

U.S. PATENT DOCUMENTS

| | | | |
|---|---|---|---|
| 3,684,339 | 8/1972 | Perkins et al. | 312/73 |
| 3,707,406 | 12/1972 | Perkins | 227/120 |
| 4,037,771 | 7/1977 | Peterson | 227/130 |
| 4,073,423 | 2/1978 | Omley | 227/7 |
| 4,224,731 | 9/1980 | Lingle | 227/7 X |

*Primary Examiner*—Paul A. Bell
*Assistant Examiner*—James L. Wolfe
*Attorney, Agent, or Firm*—Jerrold J. Litzinger

[57] ABSTRACT

A fastener magazine and guide device for use with a moveable fastening tool. The fastener magazine contains a coil of fasteners and is mounted in a fixed position in close proximity to the fastening tool. A guide is attached at its one end to the fastening tool by an angular tongue, while its other end is mounted near the fastener magazine such that the guide can move with the tool but does not transmit movement to the fastener magazine. The fastener magazine is mounted on an angle to allow for smooth feeding of the fasteners to the tool.

17 Claims, 4 Drawing Sheets

FASTENER MAGAZINE AND GUIDE DEVICE

TECHNICAL FIELD

The present invention relates to a fastener magazine and guide device for use with a moveable fastener tool attached to a machine, particularly those machines adapted for continuous work piece construction, such as attaching longitudinal assemblies such as pallet building machines and the like.

BACKGROUND OF THE INVENTION

Several machines have been developed to attach longitudinal assemblies such as pallets, fencing and lattice-work. Many of these machines feature the use of one or more fastening devices, such as nailing tools and staplers, adapted to repeatedly place a fastener in a given work piece as that work piece is passed by the fastening tool.

One recent improvement in those machines of this type which utilize nailing tools has been an improvement to the tool mounts which attach the nailing tools to the machine frame. Such improvement has been the development of a moveable or "floating" tool mount which allows the tool to accommodate irregularities in the passing work piece by providing for vertical movement of the tool in response to these irregularities. The improved tool mount also allows the nailing tool to swivel slightly in the downstream direction as the nail is being driven. This allows the nailing tool barrel to follow the nail location slightly as the work piece is passed thereby. Together, these two ranges of movement, which are independent of one another, allow for more accurate nail placement and nail depth. Such improvement is described in U.S. Pat. application No. 07/262,884 filed Oct. 26, 1988, by Scott N. Allspaw, entitled "Pallet Building Machine" which has been assigned to the owner of the present application, and is hereby incorporated herein by reference.

One of the other characteristics of the class of machines described above is that they generally consume very large amounts of fasteners due to their relatively high cyclic rate of fastener delivery. It is therefore desirable, if not in fact necessary, to provide relatively large capacity magazines of fasteners to avoid the machine operators having to continuously reload the fastener magazines which would defeat the purpose of automation. It has been found that the use of large coils of fasteners (such as nail belts) provide the best high-volume capacity and ease of delivery.

Because the fastening tool must be allowed to move freely as described above, it is not practical to have such a large fastener magazine attached directly to the tool itself. This is particularly true for the downstream swivel of the tool in the above-described mount, since this movement is in response to the recoil of the tool which could not overcome the heavy lOad Of a large volume magazine. Such a large magazine would therefore completely prevent the swivel movement of the tool and would seriously hinder the tool's movement along the vertical axis.

It is therefore an object of the present invention to provide a fastener magazine capable of containing and dispensing a large volume of fasteners while providing a guide device capable of properly delivering the fasteners to the fastener tool and orienting same for insertion by the tool. Another object of the present invention is to provide such a fastener magazine and guide device which will allow a moveable fastener tool attached to a machine to move freely and without transmitting substantial portions of that movement to the fastener magazine or disrupting the progression of the plurality of ordered fasteners from the feed mechanism of the fastening tool. In this way, the present invention prevents stoppage of the assembly process due to jamming of the fastening tool which can result from misalignment of the ordered fasteners resulting from vibration or accidental interference with the fasteners as they proceed toward the fastening tool. Accomplishing such objectives also prevents substantial vibration from being transmitted to the fastener magazine or to the machine to which it may be attached.

Several fastening tools with fastener magazines are known in the art. These include U.S. Pat. Nos. 3,684,339; 3,707,406; 4,037,771; 4,073,423 and 4,224,731; all of which are incorporated herein by reference.

However, the prior art devices have failed to provide for a fastener magazine and guide device which provides for the use of a high volume fastener magazine with the capability of uniformly and securely dispensing a plurality of fasteners to a moveable fastening tool.

Other advantages of the present invention will be apparent from an appreciation of its full scope in light of the following drawings, description and claims.

DESCRIPTION OF THE DRAWINGS

FIG. I is a partial elevational view of a machine adapted for continuous construction of a work piece (i.e., a pallet-building machine) with which the present invention may be used.

DETAILED DESCRIPTION OF THE PREFERRED EMBODIMENT

The fastener magazine and guide device of the present invention may be used in any application where it is necessary to allow a fastening tool to be in motion relative to a fixed magazine. This will be the case, for instance, where a magazine is held stationary on or in close proximity to a machine adapted for continuous work piece construction, such as those used for attaching longitudinal assemblies, such as pallet-building machines and the like.

Figure 1:
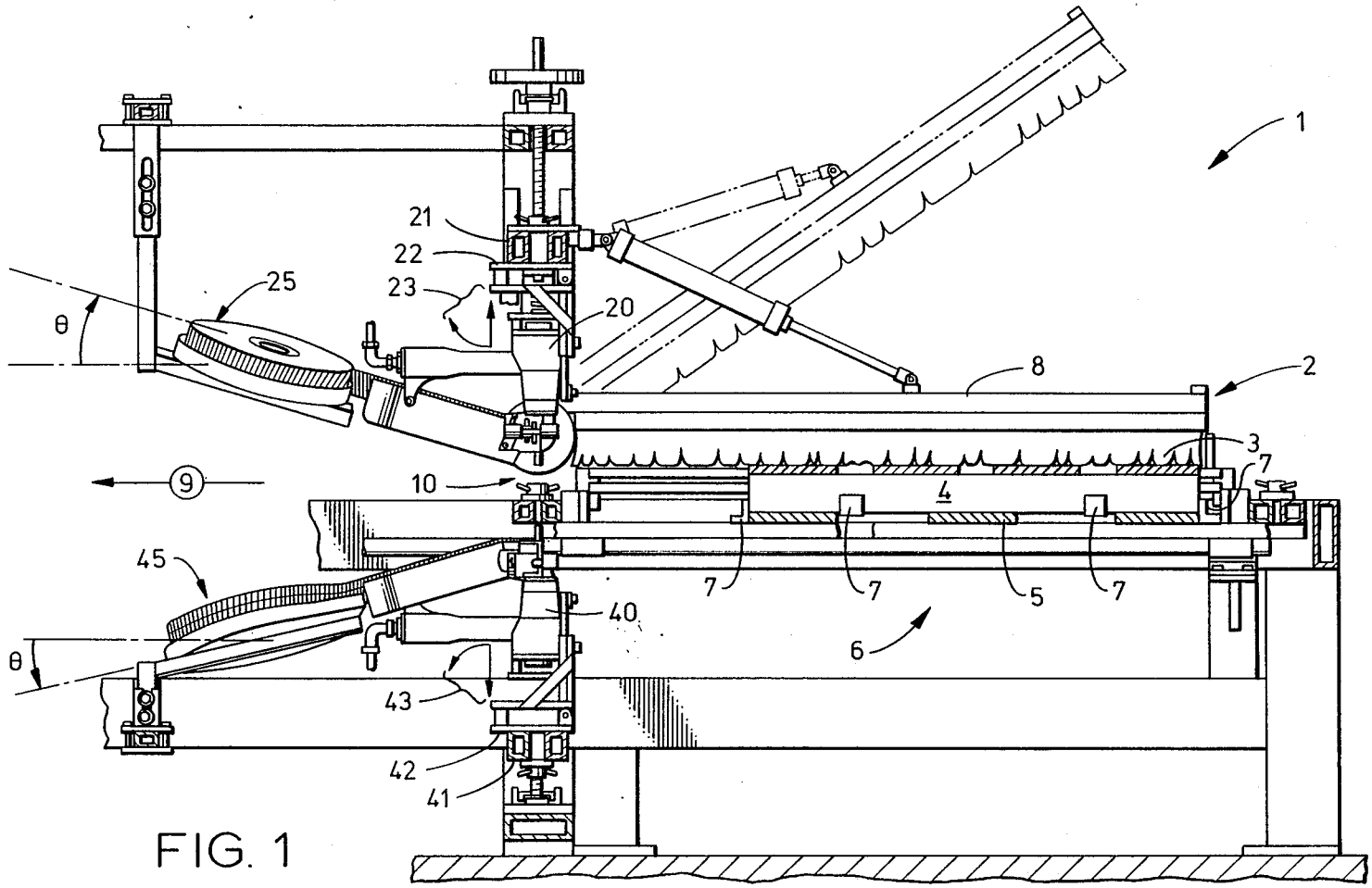

An example of such a machine is shown in part in FIG. 1. FIG. 1 shows a pallet-building machine which is the subject of U.S. Pat. application No. 07/262,884 filed Oct. 26, 1988, by Scott N. Allspaw, entitled "Improvements in a Pallet Building Machine". Pallet machine 1 has an upstream end 2 and a downstream end (not shown). Unassembled pallet pieces 3, 4 and 5 are held in alignment bed 6 by cooperation of jig system 7 and hold-down clamp 8. The unassembled pallet assembly is transported, by movement of the jig system downstream along longitudinal axis 9, passing by nailing station 10. At nailing station 10 the unassembled pallet pieces are nailed from above and from below by nailing tools 20 and 40, respectively. Nailing tools 20 and 40 are held on machine support members 21 and 41, respectively, by floating tool mounts 22 and 42, respectively, which are described in detail in U.S. Pat. application No. 07/262,884 filed Oct. 26, 1988, by Scott N. Allspaw, entitled "Improvements in a Pallet Building Machine". Tool mounts 22 and 42 allow their respective nailing tools to move in two directions (i.e., vertically and in a swiveling motion downstream) as indicated by movement direction arrows 23 and 43, respectively.

Figure 2:
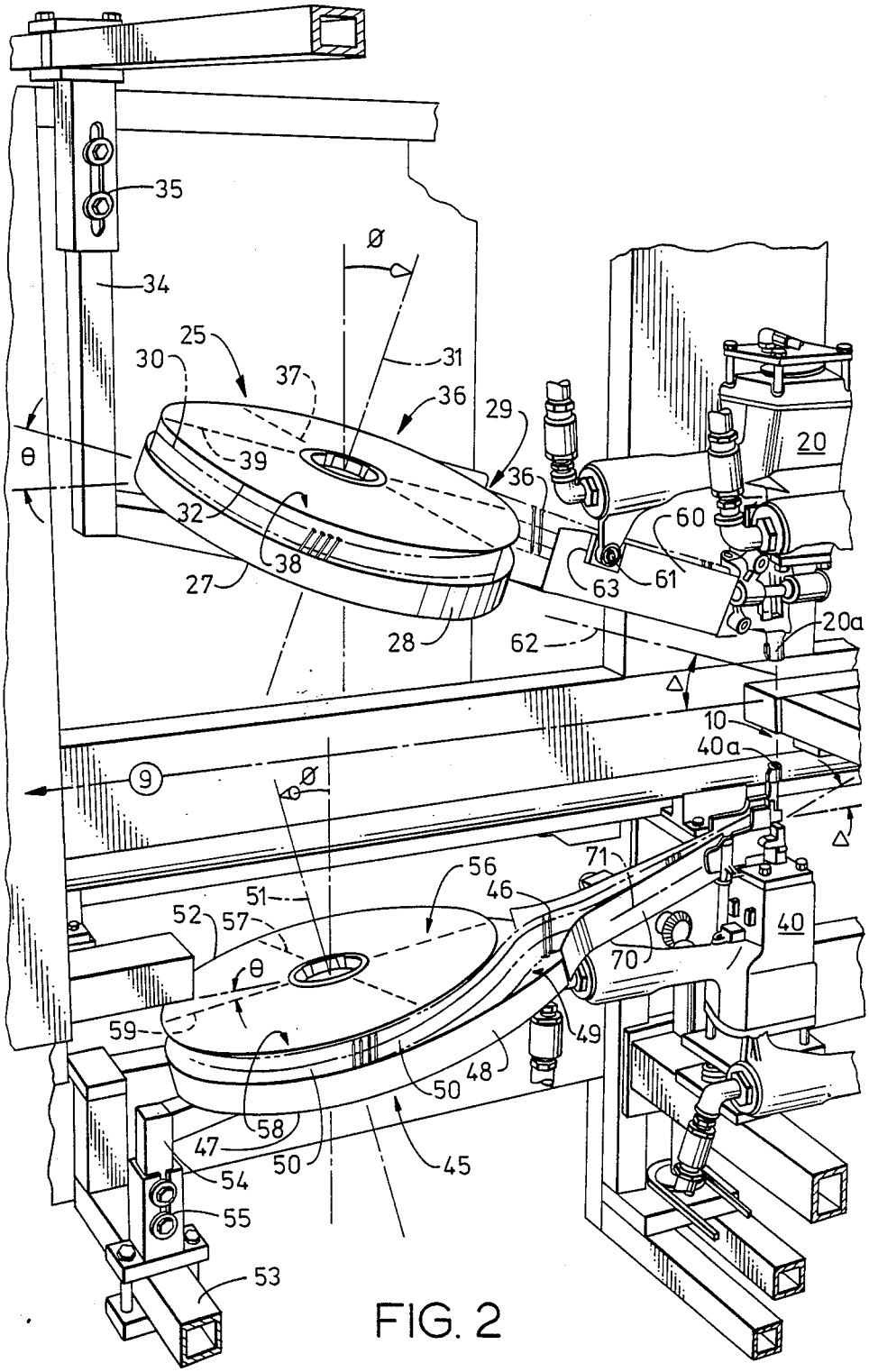
FIG. 2 is a detailed environmental view of the present invention as it would be applied in a pallet-building machine of the type shown in FIG. 1.

FIG. 2 is an angled elevational section of the pallet machines showing a section just upstream from nailing position 10 to a position just downstream from nail magazines 25 and 45. This figure shows upper nail magazine 25 which is adapted for containing a plurality of ordered nails 26 (i.e., a nail belt comprising a series of parallel nails attached to two parallel wires). Magazine 25 comprises circular base plate 27 with circular wall 28. Circular wall 28 opens at one side 29 to allow nail belt 26 to be dispensed tangentially from the belt coil. Nail magazine 25 also comprises a coil turntable (not shown) which turns about center axis 31 so as to allow nail belt 26 to be dispensed from the coil through tangential side opening 29. Nail coil 30 is held in place and protected by circular cover plate 32. The entire nail magazine is held substantially stationary and in substantially close proximity to the nailing tool 20. As can be seen in FIG. 2, this is done in the preferred embodiment by attachment to a machine Cross member 33 by support arm 34 whiCh is vertiCally adjustable via dual bolt and groove assembly 35.

It is preferred that the nail magazine be held downstream from the nailing tool 20 and held such that the side of the coil 36 as defined by line 37 nearest the nail tool 20 is tilted at an angle theta, in the range of from about 5° to about 20°, with respect to a plane perpendicular to the pull of gravity and passing through the center of said coil. A preferred range for the angle theta is from about 13° to about 17°, the most preferred angle being 15°. As can be appreciated from FIG. 2, angle theta is that below the plane perpendicular to the pull of gravity when the nail magazine is located above the barrel 20*a*.

Upper nail magazine 25 is also tilted by having the side 38 of the nail magazine 25, as defined by line 39, raised such that the nail magazine is held at an angle phi to the plane perpendicular to the pull of gravity and passing through the center of the nail magazine, in the range of from about 5° to about 20°. The preferred range for angle phi is in the range of from about 13° to about 17°, and is most preferably about 15°.

As can also be appreciated from FIG. 2, lower magazine 45 is constructed and supported in like fashion to upper magazine 25. Lower nail magazine 45 comprises lower circular base plate 47 which is provided with curved wall structure 48 having tangential opening 49 through which lower nail belt 46 is dispensed from lower nail coil 50. Lower nail magazine 45 further comprises a lower circular turntable (not shown) upon which lower nail coil 50 may be turned about central axis 51. The lower nail coil 50 also incorporates circular cover plate 52 which helps to retain and protect nail coil 50. The lower nail magazine is held substantially stationary by its attachment to lower horizontal support member 53 by attachment arm 54 which is vertically adjustable by bolt and slot adjustment means 55.

As can also be seen in FIG. 2, lower nail magazine 45 delivers nail belt 46 in upside-down fashion to lower nailing tool 40 for driving in the upward direction from nailing tool barrel 40*a*. As with upper nail magazine 25, lower nail magazine 45 is held such that the side of lower nail coil, side 56 as defined by line 57, is tilted at an angle theta with respect to a plane perpendicular to the pull of gravity and passing through the center of lower nail magazine 45, the angle theta is, in the case of the lower nail magazine 45, that above said plane rather than below it. Lower nail magazine 45, and the lower nail coil 50 it holds, is also tilted at an anqle phi by having the side of the nail magazine from which nail belt 46 is tangentially dispensed (here side 58 as defined by line 59 raised such that lower nail coil 50 is held at an angle to the plane perpendicular to the pull of gravity and passing through the center of said lower nail coil 50, where theta is in the range of from about 5° to about 20°, a more preferred range of angle theta is from about 13° to about 17°, an angle of 15° being most preferred for theta.

The present invention also comprises a guide means which is adapted to maintain a plurality of ordered fasteners (i.e., nails) substantially within a path from the fastener magazine to the fastening tool (i.e., a nail belt to a nailing tool). The guide means are mounted so as to move in concert with the movement of the fastener tool and sufficiently detached from the fastener magazine so as to prevent the transmission of substantial movement to the fastener magazine.

FIG. 2 shows both the position of upper nail guide 60 and lower nail guide 70 as applied in the present invention. Upper nail guide 60 is attached to nailing tool 20 both via a complementary shaped chuck (not shown) and by guide bolt 61. Lower nail guide 70 is attached to lower nailing tool 40 as attached in complementary fashion. Upper nail guide 60 is preferably held at an angle complementary to that of the angle of delivery of upper nail belt 26. In the preferred embodiment, this angle delta is that of the upPer nail belt delivery axis 62 above longitudinal axis 9 and should be complementary in magnitude to that of theta, that is, within a broad range of from about 5° to about 20°, a more preferred range of from about 13° to about 17°, and most preferably, about 15° . In complementary fashion, the axis of delivery 71 for lower nail belt 46 is maintained at an angle delta below longitudinal axis 9. As in the case of the upper nail magazine, angle delta of the lower nail belt 46 is congruent with angle theta of the lower nail magazine so as to best provide for a straight-line feed from the lower magazine to the lower nailing tool. Therefore, angle delta should be in the range of from about 5° to about 20°, preferably within the range of from about 13° to about 17°, and, most Preferably, 15°.

Figure 4:
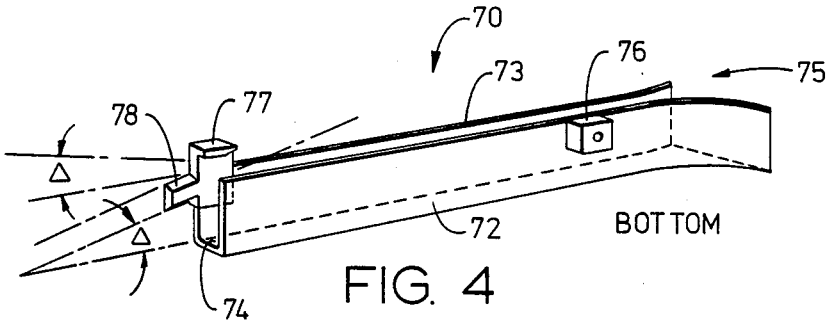
FIG. 4 is an angled perspective view of the top guide device used in accordance with the present invention.
Figure 5:
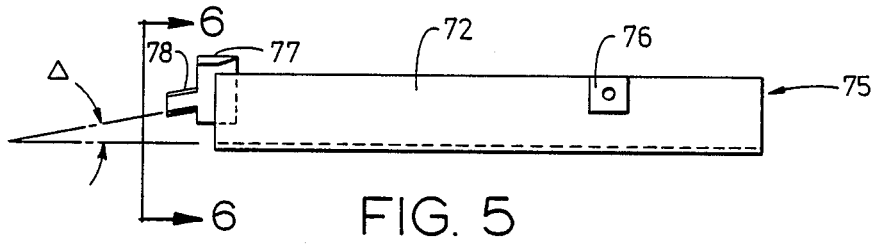
FIG. 5 is an elevational view of the guide device used in accordance with the present invention.
Figure 6:
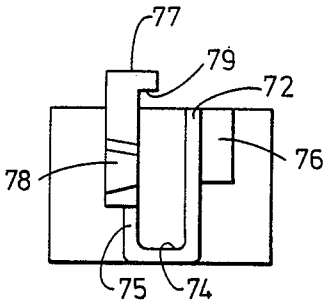
FIG. 6 is a longitudinal view of the guide device used in accordance with the present invention, taken from the end proximal to the fastening tool.

The construction of the nail guide of the preferred embodiment is shown in FIGS. 4–8. FIG. 4 shows upper nail guide 60 having side walls 61 and 62 and lower side 64. Side walls 61 and 62 are spaced so as to accommodate the width of the ordered plurality of fasteners such as, in this case, a nail belt. It is preferred that there be enough space between the side walls 61 and 62 so as to allow the nail belt to have some freedom of movement therebetween. Side walls 61 and 62 are preferably flanged outwardly at the end of the guide nearest the nail magazine 25 (i.e., end 65). Lower side 64 supports the lowermost ends of the nails in nail belt, which, in this case, is the nail point ends of upper nail belt 26. As can be appreciated from upper nail guide 60, and its attachment block 63, lower nail guide 70 is similarly fitted with an attachment block 76 which attaches the lower nail guide to lower nailing tool 40. The upper nail guide is attached to upper nailing tool 20 by attachment chuck 66 which contains tongue portion 67 which is adapted to fit into the alignment mechanism of several industrial nailing tools including Model SCN 300 commercially available from Senco Products, Inc. Modification of tongue portion 67 will accommodate the alignment mechanisms of other similar nailing tools. It will also be noted from FIG. 4 and FIG. 5 that the tongue portion 67 is angled with respect to the axis of feed so as to maintain guide 60 at an angle delta in this case below the horizontal axis.

Figure 7:
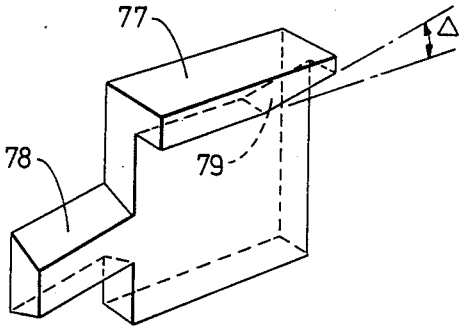
FIG. 7 is an angled view of the proximal end of the guide device used in accordance with the present invention.

FIG. 7 shows that attachment chuck 66 preferably contains an aligning surface 68 which aids in the alignment and feed of the nail belt. It is preferable that this surface be beveled at an angle equal to or congruent with angle delta.

Figure 8:
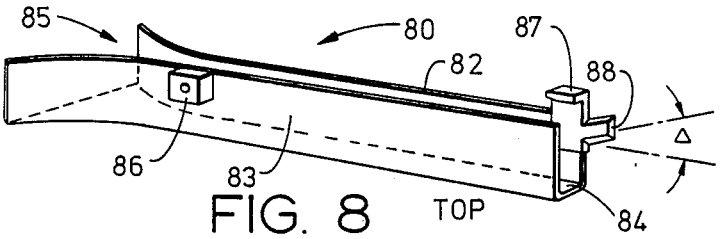
FIG. 8 is an angled perspective view of the bottom guide device used in accordance with the present invention.

Inversely, the nail guide 70 of FIG. 8 is intended for use with lower nail magazine 45, tongue portion 74 would be angled so as to maintain the nail guide 70 at an angle delta above the horizontal axis as shown in FIG. 8 with respect to the dotted line. As seen in FIG. 8, nail guide 70 comprises side walls 71 and 72 (preferably flared at the end of the guide nearest the nail magazine 45, i.e., side 75) and bottom wall 73. Nail guide attaches to lower nail tool 40 via attachment tongue 74, and also via attachment block 76.

Figure 3:
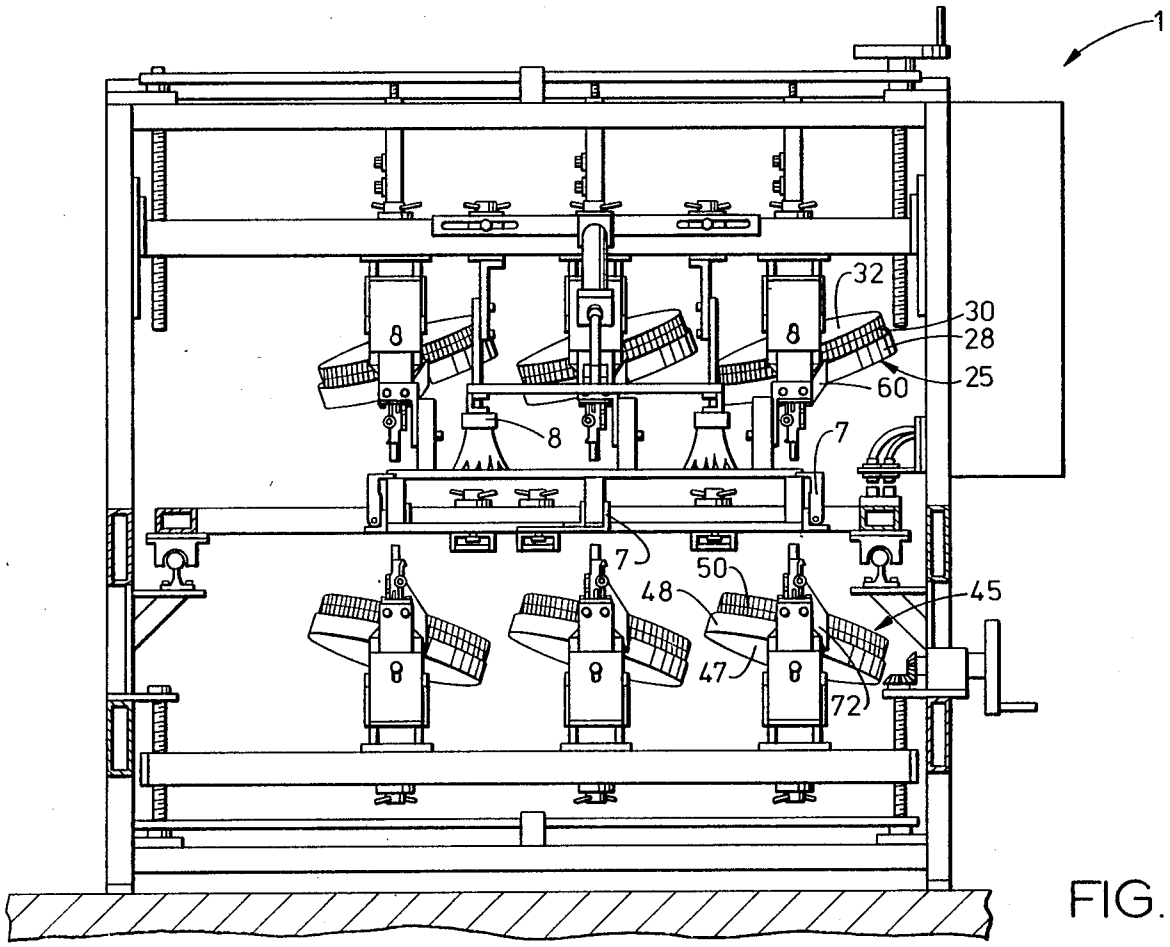
FIG. 3 is a longitudinal view in the downstream direction of the pallet-building machine shown in FIG. 1.

Finally, FIG. 3 shows a series of three upper and three lower nail magazines, each with corresponding guides, as they would be used in a pallet-making machine in accordance with the description of the preferred embodiment.

Modifications of the present invention, within the skill of the art, may be made without departing from the invention's spirit and intended function.

What is claimed is:

1. A fastener magazine and guide device for use with a moveable fastening tool attached to a magazine, comprising:

(a) a fastener magazine for containing a plurality of ordered fasteners in a coil and dispensing said fasteners tangentially from said coil for sequential insertion by said fastening tool;

(b) means for maintaining said fastener magazine substantially stationary and in substantially close proximity to said fastening tool; and (c) guide means adapted to maintain said plurality of ordered fasteners substantially within a path from said fastener magazine to said fastener tool, said guide means coupled at its forward end to said fastener tool by an angled tongue adapted to fit within said fastener tool such that said guide means is mounted so as to move in concert with the movement of said fastener tool and sufficiently detached from said fastener magazine so as to prevent the transmission of substantial movement to said fastener magazine.

2. The device according to claim 1 wherein said magazine is held downstream from said fastening tool, and is held such that the side of said coil nearest said fastening tool is tilted at an angle in the range of from about 5° to about 20° with respect to a plane perpendicular to the pull of gravity and passing through the center of said coil, and wherein said angle is that below said plane when said coil is located above the barrel end of said fastening tool and that above said plane when said coil is located below the barrel end of said fastening tool.

3. The device according to claim 2 wherein said angle at which the side of said coil nearest said fastening tool is tilted is in the range of from about 13° to about 17° with respect to a plane perpendicular to the pull of gravity.

4. The device according to claim 2 wherein said angle at which said coil is tilted is about 15° with respect to a plane perpendicular to the pull of gravity.

5. The device according to claim 1 wherein said magazine is held downstream from said fastening tool, and is held such that the side of the coil from which said plurality of ordered fasteners are tangentially dispensed is raised such that said coil is held at an angle to the plane perpendicular to the pull of gravity, in the range of from about 5° to about 20°.

6. The device according to claim 5 wherein said angle at which said side of the coil from which said plurality of ordered fasteners are dispensed is raised at an angle to the plane perpendicular to the pull of gravity of about 15°.

7. A nail magazine and guide device for use with a moveable nailing tool attached to a machine for continuous work piece assembly, such as a pallet building machine and the like, comprising:

(a) a nail magazine for containing a plurality of ordered nails in a coil and dispensing said nails tangentially from said coil for sequential driving by said nailing tool;

(b) means for maintaining said nail magazine substantially stationary and in substantially close proximity to said nailing tool;

(c) guide means adapted to maintain said plurality of ordered nails substantially within a path from said nail magazine to said nailing tool, said guide means coupled at its forward end to said nailing tool by an angled tongue adapted to fit within said nailing tool such that said guide means is mounted so as to move in concert with the movement of said nailing tool and sufficiently detached from said nail magazine so as to prevent the transmission of substantial movement to said nail magazine.

8. The device according to claim 7 wherein said magazine is held downstream from said nailing tool, and is held such that the side of said coil nearest said nailing tool is tilted at an angle in the range of from about 5° to about 20° with respect to a plane perpendicular to the pull of gravity and passing through the center of said coil, and wherein said angle is that below said plane when said coil is located above the barrel end of said nailing tool and that above said plane when said coil is located below the barrel end of said nailing tool.

9. The device according to claim 8 wherein said angle at which the side of said coil nearest said nailing tool is tilted is in the range of from about 13° to about 17° with respect to a plane perpendicular to the pull of gravity.

10. The device according to claim 8 wherein said angle at which said coil is tilted is about 15° with respect to a plane perpendicular to the pull of gravity.

11. The device according to claim 8 wherein said nail magazine and said guide means are aligned so as to dispense said plurality of ordered nails along a line at an angle of from about 13° to about 17° from the horizontal when said nailing tool drives said nails along the vertical axis.

12. The device according to claim 7 wherein said magazine is held downstream from said nailing tool, and is held such that the side of the coil from which said plurality of ordered nails are tangentially dispensed is raised such that said coil is held at an angle to the plane perpendicular to the pull of gravity, in the range of from about 5° to about 20°.

13. The device according to claim 12 wherein said angle at which said side of the coil from which said plurality of ordered nails are dispensed is raised at an angle to the plane perpendicular to the pull of gravity, in the range of from about 13° to about 17°.

14. The device according to claim 12 wherein said angle at which said side of the coil from which said plurality of ordered nails are dispensed is raised at an angle to the plane perpendicular to the pull of gravity, of about 15°.

15. The device according to claim 7 wherein said magazine is held downstream from said nailing tool, and is held such that the side of said coil nearest said nailing tool is tilted at an angle in the range of from about 5° to about 20° with respect to a plane perpendicular to the pull of gravity and passing through the center of said coil, and wherein said angle is that below said plane when said coil is located above the barrel end of said nailing tool and that above said plane when said coil is located below the barrel end of said nailing tool; and wherein said magazine is held such that the side of the coil from which said plurality of ordered nails are tangentially dispensed is raised such that said coil is held at an angle to the plane perpendicular to the pull of gravity in the range of from about 5° to about 20°.

16. The device according to claim 7 wherein said magazine is held downstream from said nailing tool, and is held such that the side of said coil nearest said nailing tool is tilted at an angle in the range of from about 13° to about 17° with respect to a plane perpendicular to the pull of gravity and passing through the center of said coil, and wherein said angle is that below said plane when said coil is located above the barrel end of said nailing tool and that above said plane when said coil is located below the barrel end of said nailing tool; and wherein said magazine is held such that the side of the coil from which said plurality of ordered nails are tangentially dispensed is raised such that said coil is held at an angle to the plane perpendicular to the pull of gravity in the range of from about 13° to about 17°.

17. The device according to claim 7 wherein said magazine is held downstream from said nailing tool, and is held such that the side of said coil nearest said nailing tool is tilted at an angle of about 15° with respect to a plane perpendicular to the pull of gravity and passing through the center of said coil, and wherein said angle is that below said plane when said coil is located above the barrel end of said nailing tool and that above said plane when said coil is located below the barrel end of said nailing tool; and wherein said magazine is held such that the side of the coil from which said plurality of ordered nails are tangentially dispensed is raised such that said coil is held at an angle to the plane perpendicular to the pull of gravity in the range of about 15°.

* * * * *